US005224227A

United States Patent [19]

McGinley

[11] Patent Number: 5,224,227

[45] Date of Patent: Jul. 6, 1993

[54] ATTACHMENT FOR ELEVATING THE LEGS OF A BED

[76] Inventor: Edgar V. McGinley, 66 Hillcrest Ave., Summit, N.J. 07901

[21] Appl. No.: 934,782

[22] Filed: Aug. 24, 1992

Related U.S. Application Data

[63] Continuation-in-part of Ser. No. 749,197, Aug. 23, 1991, abandoned.

[51] Int. Cl.[5] ..... A47C 21/00; A47C 31/00

[52] U.S. Cl. ..... 5/509.1; 248/188.2

[58] Field of Search ..... 5/509.1, 658, 11; 248/188.2

[56] References Cited

U.S. PATENT DOCUMENTS

| | | | |
|---|---|---|---|
| 575,806 | 1/1997 | Garvey | 248/188.2 |
| 2,072,791 | 3/1937 | Baer | 5/658 |
| 2,366,867 | 1/1945 | Nichthauser | 248/188.2 |
| 2,933,850 | 4/1960 | Martin | 5/509.1 |
| 2,974,352 | 3/1961 | Lockwood | 248/188.2 |

FOREIGN PATENT DOCUMENTS

| | | | |
|---|---|---|---|
| 59113 | 3/1912 | Switzerland | 248/188.2 |

*Primary Examiner*—Alexander Grosz
*Attorney, Agent, or Firm*—Richard T. Laughlin

[57] ABSTRACT

An elevator stand for a bed leg for tilting the bed for use by a person with various conditions. The stand has a base portion for resting on a floor surface, and has an upper receiving portion which has a top surface recess with a bottom bearing surface and an inner sidewall surface telescoping over the bed leg. The elevator is provided with means for securing the legs of the bed to the elevators.

2 Claims, 1 Drawing Sheet

ATTACHMENT FOR ELEVATING THE LEGS OF A BED

This is a continuation-in-part of patent application Ser. No. 07/749,197 filed Aug. 23, 1991 now abandoned.

The invention relates to a bed attachment or elevator and, in particular, the invention relates to a bed elevator which has two or more stands for placement under upper or lower legs of a bed or all of the legs with each stand having a top recess and an interior bearing surface for stability.

BACKGROUND OF THE INVENTION

The prior art bed elevator is described in U.S. Pat. No. 2,933,850 issued April, 1960 to Martin. Martin discloses a stand with a shallow upper surface that can be raised endlessly by stacking similar units without regard to the effect of lateral force. The structure disclosed in this patent does not resist a horizontal impact force as would occur when moving the bed, which would cause the stand to topple. Related patents include:

U.S. Pat. No. 3,795,925, issued Mar. 12, 1974
U.S. Pat. No. 1,670,601, issued May 22, 1928,
U.S. Pat. No. 2,067,515, issued Jan. 12, 1937,
U.S. Pat. No. 2,072,791, issued Mar. 2, 1937,
U.S. Pat. No. 2,147,538, issued Feb. 14, 1939,
U.S. Pat. No. 2,599,723, issued Jun. 10, 1952,
U.S. Pat. No. 3,178,146, issued Apr. 13, 1965,
U.S. Pat. No. 3,310,289, issued Mar. 21, 1967, and
U.S. Pat. No. 4,312,088, issued Jan. 26, 1982.

Other related patents, which were cited in the above-mentioned basic patents, include:

U.S. Pat. No. 4,312,088, issued January 1982,
U.S. Pat. No. 575,806, issued January 1897,
U.S. Pat. No. 2,633,898, issued April 1953,
U.S. Pat. No. 2,750,709, issued June 1956,
U.S. Pat. No. 2,893,164, issued July 1959, and
U.S. Pat. No. 3,795,425, issued March 1974.

The prior art bed elevator includes a bed which has a frame with legs, with a pair of elevator stands, each stand having a base portion for resting on the floor and having an upper portion for supporting the bed frame.

As indicated above a major problem with the prior art bed elevator is that a horizontal impact force which is accidently or intentionally applied to the bed in a longitudinal direction causes a moment on each stand that causes the stand to topple.

The foregoing and other objects, features and the advantages of the invention will be apparent from the following description of the preferred embodiment of the invention as illustrated in the accompanying drawings.

SUMMARY OF THE INVENTION

According to the present invention, a bed elevator is provided. This elevator functions with a bed having a frame with supporting legs and comprises a pair of elevator stands, each stand having a base portion for securely resting on the floor and having an upper portion with a vertical recess which receives a respective leg affixed to the bed frame, the recess having an interior bearing surface and having an inner overlap surface which snugly overlaps the leg, thereby transmitting a bed vertical load and preventing the toppling of the stand due to a horizontal load or movement.

In one of the preferred embodiments the vertical recessed portion of the elevator is provided with means for securing the elevator to its associated leg of the bed.

By using the elevators of the invention each having a recess with a bearing surface and with an inner surface, the toppling of the stands due to a longitudinal impact force is avoided.

Some conditions often favorably influenced by elevating the head of a bed include:

1) Hiatus Hernia;
2) GERD (gastro-esophageal reflux disorder);
3) Heartburn;
4) Water-Brash (sour stomach);
5) Certain sleep disorders related to snoring, obesity, chronic pulmonary disorders, smokers cough, anxiety or other emotional disorders;
6) Congestive heart failure;
7) Abdominal discomfort associated with pregnancy;
8) Certain painful neck and shoulder and back conditions.

Some conditions often favorably influenced by elevating the foot of a bed include:

1) Fainting or dizziness related to vaso-motor instability (needles, blood, hospital smell, etc.);
2) Shock—due to various causes;
3) Conditions of the lower extremities—such as sprains, infections, inflammatory conditions.

DESCRIPTION OF THE PREFERRED EMBODIMENT

Figure 1:
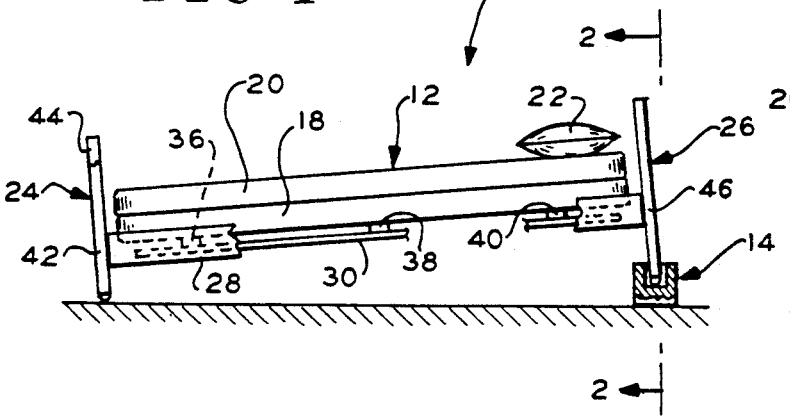
FIG. 1 is an elevation view of a bed assembly according to the present invention.
Figure 2:
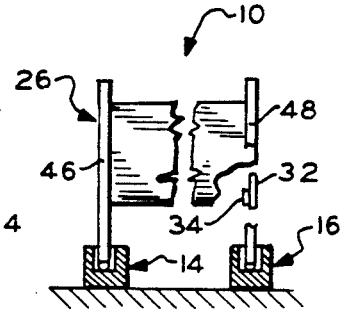
FIG. 2 is a section view as taken along the line 2—2 of FIG. 1.

As shown in FIGS. 1 and 2, a bed assembly 10 is provided. Assembly 10 includes a bed generally indicated at 12, near and far elevator stands 14, 16, a box spring 18, a mattress 20, and a pillow 22.

The bed 12 includes a footboard 24, a headboard 26, a near sideboard 28 which has an integral near rail 30, and a far sideboard 32 which has an integral far rail 34. Parts 24, 26, 28, 32 form a frame. The bed 12 also has a plurality or three cross slats 36, 38, 40. The footboard 24 has a near leg 42 which is fixedly connected to the near sideboard 28, and has a far leg 44 which is fixedly connected to far sideboard 32. The headboard 26 has a near leg 46 which is fixedly connected to near sideboard 28, and has a far leg 48 which is fixedly connected to far sideboard 32.

Figure 3:
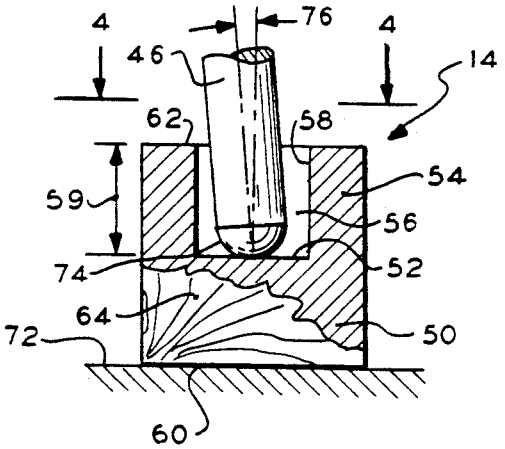
FIG. 3 is an enlarged view of a portion of FIG. 1.
Figure 4:
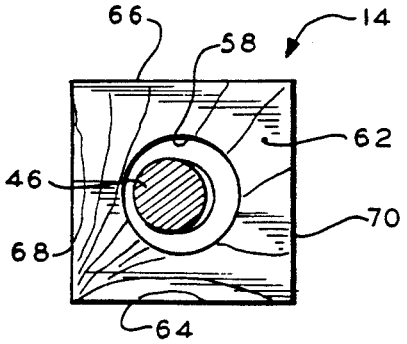
FIG. 4 is a plan section view as taken along the line 4—4 of FIG. 3.

As shown in FIGS. 3 and 4 of the drawings, near stand 14 is identical to far stand 16. Near stand 14 has a lower base portion 50 which has an interior bearing surface 52. Near stand 14 also has an upper receiving portion 54 which has a recess 56 with a circular inner surface 58. Near stand 14 also has bottom and top exterior surfaces 60, 62, and has near and far exterior surfaces 64, 66 and has left and right exterior surfaces 68, 70. Bottom surface 60 bears on a conventional floor surface 72.

Inner surface 58 snugly overlaps the leg 46. Bottom bearing surface 52 is disposed at a depth 59, or telescoped length, of selective size below top exterior surface 62. Recess surface 58 has a clearance of selective size from an outer surface of leg 46. Such clearance is smaller in size than the recess depth 59. In this embodiment, leg 46 and recess inner side surface 58 are cylindrical in shape. The clearance in size in this embodiment equals the diameter of surface 58 less the outer diameter of leg 46.

Near leg 46 has a rounded bottom surface 74 for point contact. Near leg 46 also has a fixed tilt angle 76 in its resting condition.

In use, a person can raise a bed leg 46 by hand, and can position the stand 14 using one foot, and can then lower the leg 46 into recess 56 for bearing on inner surface 52.

One prototype of this embodiment or assembly 10 has stands 14,16 each made of a wood, plastic or metal or similar material and each having overall dimensions of about 4 to about 8 inch height by about 4 to about 6 inch width by 6 inch depth.

Figure 5:
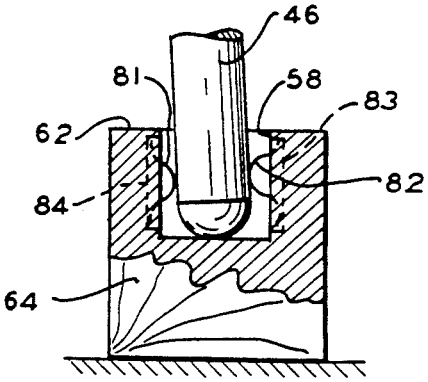
FIG. 5 is a sectional view of a modification of FIG. 3 showing means for securing the elevator to a leg of a bed frame.
Figure 6:
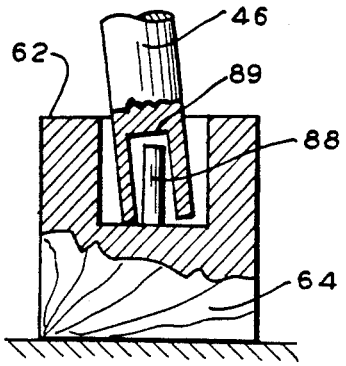
FIG. 6 is a sectional view of a second modification of FIG. 3 showing means for securing the elevator to a leg of a bed frame.

A further modification of the bed elevator has means for retaining the leg in the recessed portion is shown in FIGS. 5 and 6 of the drawings. A typical such means is flexible metal clips 81, 82 shown in FIG. 5 formed of tension steel bands which will compress when the leg 46 is placed in the stand causing pressure against the side of the leg to retain it in place. Recessed groves 83, 84 are provided in the side of the recess to allow the free movement of the spring clips when placed under tension. The leg 46 is released by depressing the clip by hand pressure to allow the passage of the leg.

Another method of retaining the leg in a fixed position is the use of a flexible ring which will expand when the leg is passed into the recess and will contract around the leg holding it in contact with the bed elevator.

A further method of securing the elevator in place is shown in FIG. 6 wherein a vertical extension pin 88 extends from the bottom of the recess into a receptacle 89 in the base of the leg.

The advantages of bed assembly 10 are indicated hereafter.

A) Toppling of stands 14,16 due to a longitudinal impact force on bed 12 is avoided.

B) Stand 14 can be made of a molded material, such as a molded plastic, wood or metal material, as desired.

C) Use by persons with selective problems can be facilitated using assembly 10.

D) Stand 14 can be used with roller wheel bed posts and with angle iron bed posts.

E) Stand 14 does not require screw thread features nor require ratchet features thereby minimizing the manufacturing cost.

While the invention has been described in its preferred embodiment, it is to be understood that the words which have been used are words of description rather than limitation and that changes may be made within the purview of the appended claims without departing from the true scope and spirit of the invention in its broader aspects.

What is claimed is:

1. In a bed assembly having a bed having a frame with two support legs fixedly connected thereto;

an elevator having two stands respectively supporting the corresponding legs;

each said stand having a base portion for resting on a floor surface and having an upper receiving portion with a vertical recess for receiving its respective leg, and each of said recesses having an inner side surface and having a bottom interior bearing surface for bearing contact by its respective leg, the improvement which comprises each of said legs has a selectively shaped outer surface, each said recess being a substantially cylindrical cavity with a constant diameter and with an inner side surface shaped to accommodate the leg outer surface, and wherein said recess inner side surface telescopes over the leg outer surface and wherein said recess inner surface and said leg outer surface have therebetween a clearance, said leg outer surface having a telescoped length, said telescoped length being grater than said clearance, thereby preventing toppling of the stand, wherein means is provided for securing each leg of the bed to its associated recess comprising opposed flexible metal clips which will compress when the leg is placed in the stand causing pressure against opposite sides of the leg to retain the leg in place.

2. The bed assembly as defined in claim 1 wherein the metal clips are flexible steel and recess groves are provided in the side of the each recess to receive the metal clips and hold the metal clips in place.

* * * * *